US005379526A

United States Patent [19]

Haverinen

[11] Patent Number: 5,379,526

[45] Date of Patent: Jan. 10, 1995

[54] APPARATUS FOR ELIMINATING THE FLUTTER OF A PAPER WEB IN THE DRYER SECTION OF A PAPERMAKING MACHINE

[75] Inventor: Timo Haverinen, Masku, Finland

[73] Assignee: Valmet Paper Machinery Inc., Helsinki, Finland

[21] Appl. No.: 89,891

[22] Filed: Jul. 12, 1993

[51] Int. Cl.[6] ..... F26B 11/02

[52] U.S. Cl. ..... 34/114; 34/116; 34/117; 34/120

[58] Field of Search ..... 34/114, 115, 116, 117, 34/120, 122, 123

[56] References Cited

U.S. PATENT DOCUMENTS

| | | | |
|---|---|---|---|
| 4,502,231 | 3/1985 | Fissmann et al. | 34/114 |
| 4,669,198 | 6/1987 | Wedel | 34/116 |
| 4,694,587 | 9/1987 | Eskelinen | 34/116 |
| 4,821,429 | 4/1989 | Sieberth | 34/114 |
| 4,891,891 | 1/1990 | Wedel | 34/114 |
| 4,893,741 | 1/1990 | Heinzmann | 34/116 |
| 4,899,463 | 2/1990 | Heikkila et al. | 34/116 |
| 5,086,571 | 2/1992 | Hietanen | 34/117 |
| 5,115,581 | 5/1992 | Viitanen | 34/115 |

FOREIGN PATENT DOCUMENTS 80103 12/1989 Finland .

*Primary Examiner*—Denise L. Gromada
*Attorney, Agent, or Firm*—Pollock, Vande Sande & Priddy

[57] ABSTRACT

An apparatus in the dryer section of a papermaking machine for preventing the flutter of a paper web comprises an air blow box located between adjacent cylinders within a loop of a support fabric (F) formed by a guide roll. The blow box includes a blow chamber, into whose wall opens a nozzle for providing an ejector assembly together with an opposite wall included in the box. The walls build therebetween a flow path direct towards an uncovered section of support fabric (F). An air current discharging from nozzle is delivered through the flow path and into a space confined by the uncovered section of support fabric (F) and thereby through the support fabric. The air current creates a vacuum in a space defined between the ejector assembly and a section of support fabric (F) carrying the web (W).

6 Claims, 5 Drawing Sheets

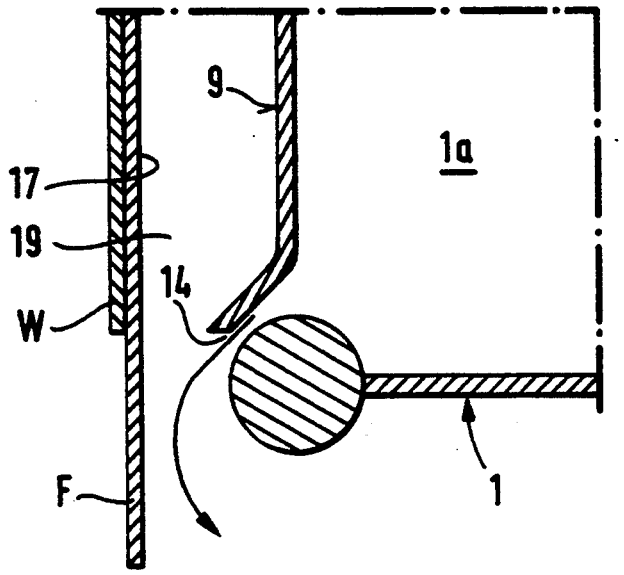
Fig. 4b (A-A)
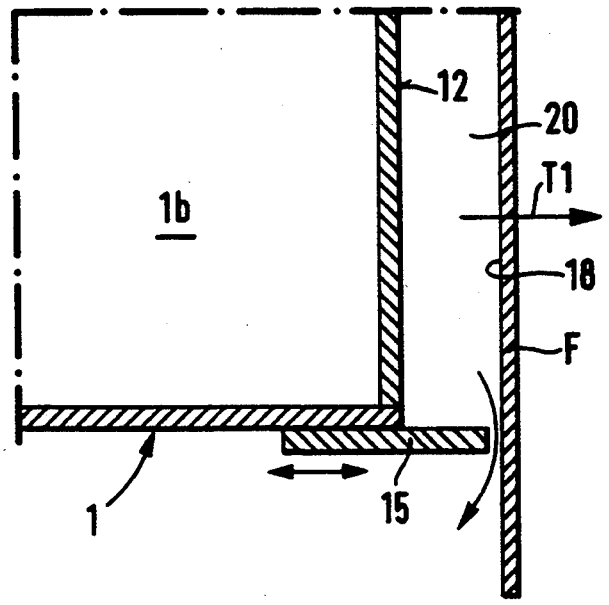
Fig. 4c (B-B)

APPARATUS FOR ELIMINATING THE FLUTTER OF A PAPER WEB IN THE DRYER SECTION OF A PAPERMAKING MACHINE

BACKGROUND OF THE INVENTION

The present invention relates to an apparatus for eliminating the flutter of a paper web in a double fabric configuration in the dryer section of a papermaking machine. The operational speeds of papermaking machines have increased continuously over the recent years and are already approaching 1600 m/min. Thus, the flutter of a web will become a serious problem impairing the performance of a papermaking machine. The support of a web from a press section to a dryer section within a single fabric run is controllable by prior known technology but, within a double fabric run, especially in a first double fabric configuration, problems have been encountered at high running speeds.

In a double fabric run, a web is adapted to travel along a tortuous path between cylinders included in two tiers such that the web is always supported against the dryer cylinders of the same tier by means of one and the same dryer fabric. Thus, a double fabric each configuration includes two fabrics for supporting a web against the cylinders of a corresponding tier. Hence, the web will have long open draws when advancing from one tier of cylinders to the next. These open draws are susceptible to fluttering as a result of air currents produced by the moving parts of a dryer configuration. Efforts have been made to eliminate this problem by reducing the lengths of open draws with suitable arrangements of cylinders and their fabric guide rolls controlling the fabrics between the cylinders and by means of various blow boxes included in such open draws.

There is a prior known solution, wherein the fabric guide rolls controlling a dryer fabric between cylinders of one and the same tier are re-located on a tangential line between the cylinders such that the dryer fabric is able to escort a web as far as possible, that is the web shall not separate from the fabric until the point, at which the fabric winds around the periphery of a fabric guide roll. A pocket thus formed by the roll and the fabric is provided with a blow box, whose nozzles are used for creating a vacuum over a fabric section between the dryer cylinder and the fabric guide roll for retaining the web in contact with the fabric and for blowing air through the free section of a fabric located on the other side into a pocket on the other side. The apparatus includes three nozzles which, in view of producing air currents caused by a moving fabric and a roll, require a major amount of air which can amount up to 1400 $m^3$h/lateral meter. The large amount of air leads to complicated and expensive assemblies. The air to be blown is either compensation air or a mixture of compensation air and return air.

SUMMARY OF THE INVENTION

An object of the invention is to introduce an apparatus for overcoming the present above problems. In order to achieve this object, an apparatus of the invention is primarily characterized by the features set forth in the following. The box includes a blow chamber, into whose wall opens a nozzle serving as a component in an ejector assembly. The nozzle is directed towards a space defined by a free section of the dryer fabric for producing an air current or flow through the free section into a pocket on the other side. By virtue of the ejector assembly, the same air current generates a vacuum in a space downstream of the nozzle in the flowing direction, the space being defined by a web-supporting section of the dryer fabric. On the other side of the fabric, this vacuum pulls the web into contact with the fabric by virtue of the air permeability of the dryer fabric.

In addition, the invention includes some preferred constructional embodiments for the apparatus.

BRIEF DESCRIPTION OF THE DRAWINGS

The invention will now be described in more detail with reference made to the accompanying drawings, in which FIG. 4*b* is a sectional view of a detail along a plane A—A in FIG. 4*a*, and FIG. 4*c* is a sectional view of a detail along a plane B—B in FIG. 4*a*.

DETAILED DESCRIPTION OF THE PREFERRED EMBODIMENTS

Figure 1:
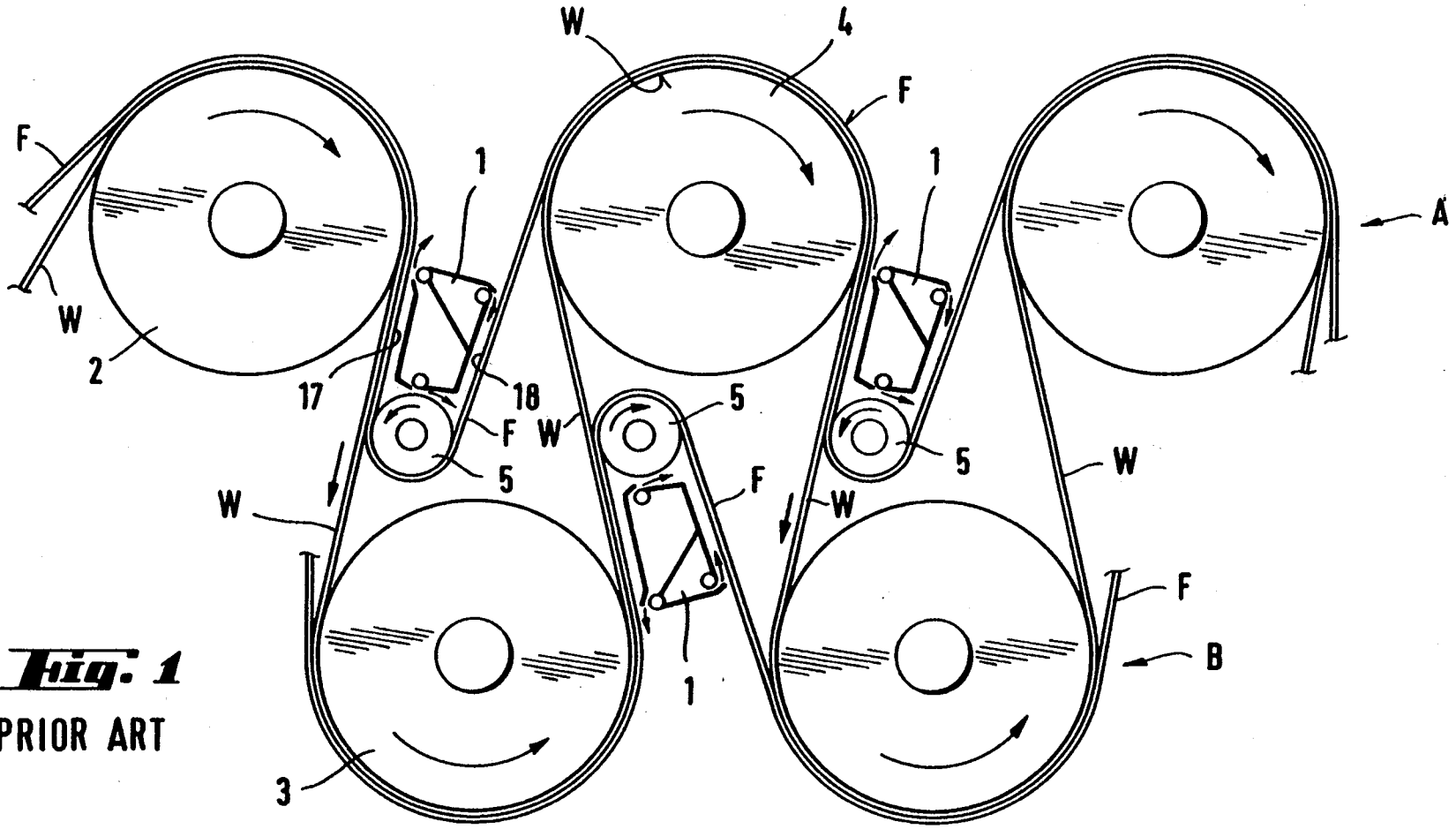
Fig. 1 PRIOR ART
FIG. 1 is a side view, showing a prior known double fabric configuration for a papermaking machine.

FIG. 1 illustrates the disposition of fabric guide rolls and blow boxes in a double fabric configuration, including cylinders in two tiers A and B. A dryer fabric F travels together with a web from a cylinder 2 of first tier A to a fabric guide roll 5, this section being designated at 17. From the fabric guide roll the web W progresses by itself to a dryer cylinder 3 of second tier B and the fabric guide roll 5 directs the fabric to a dryer cylinder 4 which is next in first tier A, for placing it there on top of web W winding around the cylinder. This section is designated as 18. In a similar fashion and supported by the fabric, web W travels up to a fabric guide roll 5 also downstream of the cylinders of second tier B.

Figure 2:
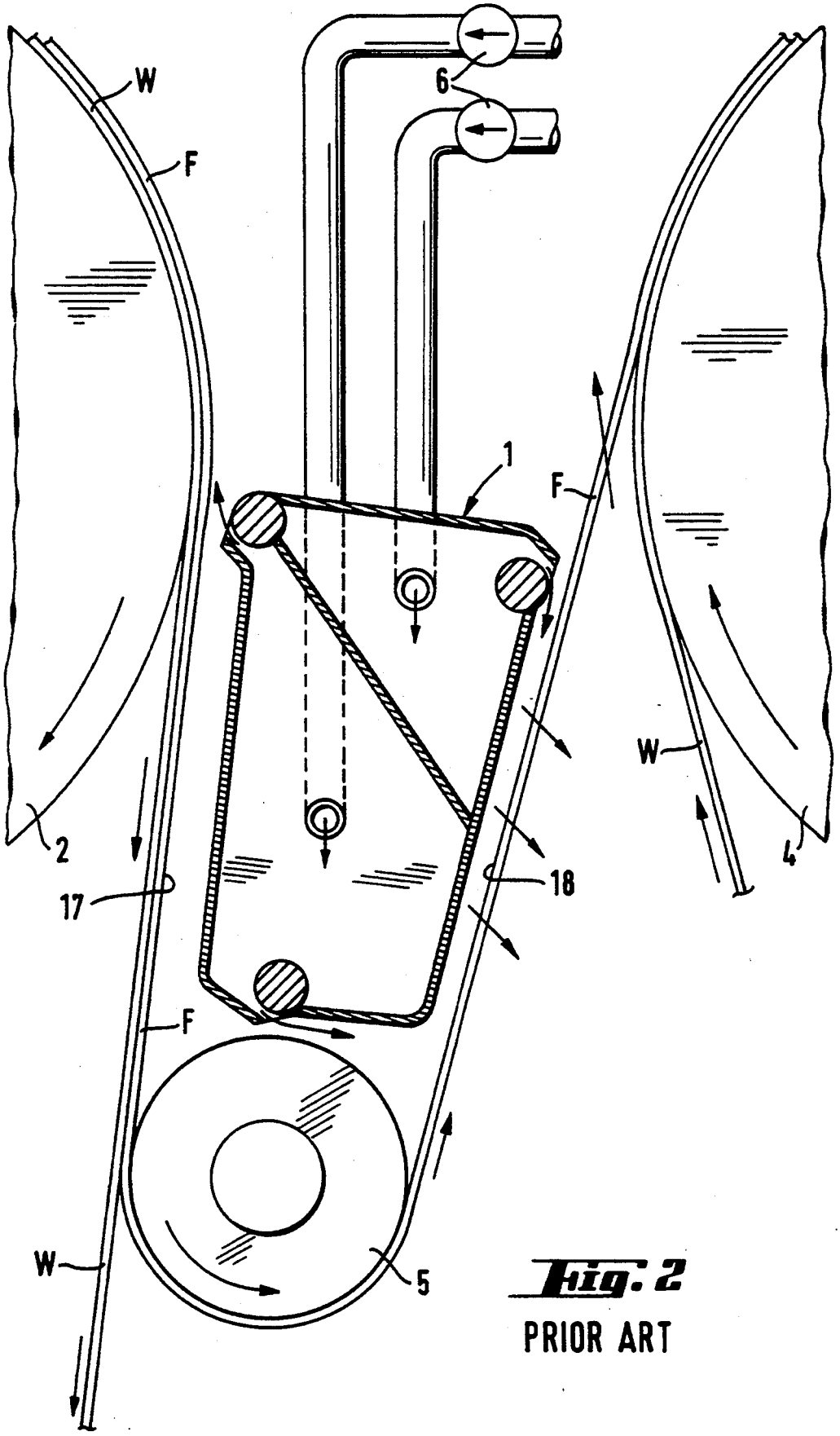
Fig. 2 PRIOR ART
FIG. 2 is a larger-scale view of an apparatus in the double fabric configuration of FIG. 1 as a cross-section in the machine direction.

FIG. 2 shows the above-mentioned prior art apparatus used in a double fabric configuration. Its reference numerals for respective components are identical to those used above. A blow box 1 includes three nozzles, one blowing air against the traveling direction of the uncovered jacket of a fabric guide roll 5 and another blowing air against the traveling of a free or uncovered fabric section 18. The nozzles are capable of producing an air current through section 18. The third nozzle blows air against the traveling direction of a joint fabric and web section 17 and together with the nozzle blowing against the fabric guide roll produces a vacuum in a space defined by section 17.

Figure 3:
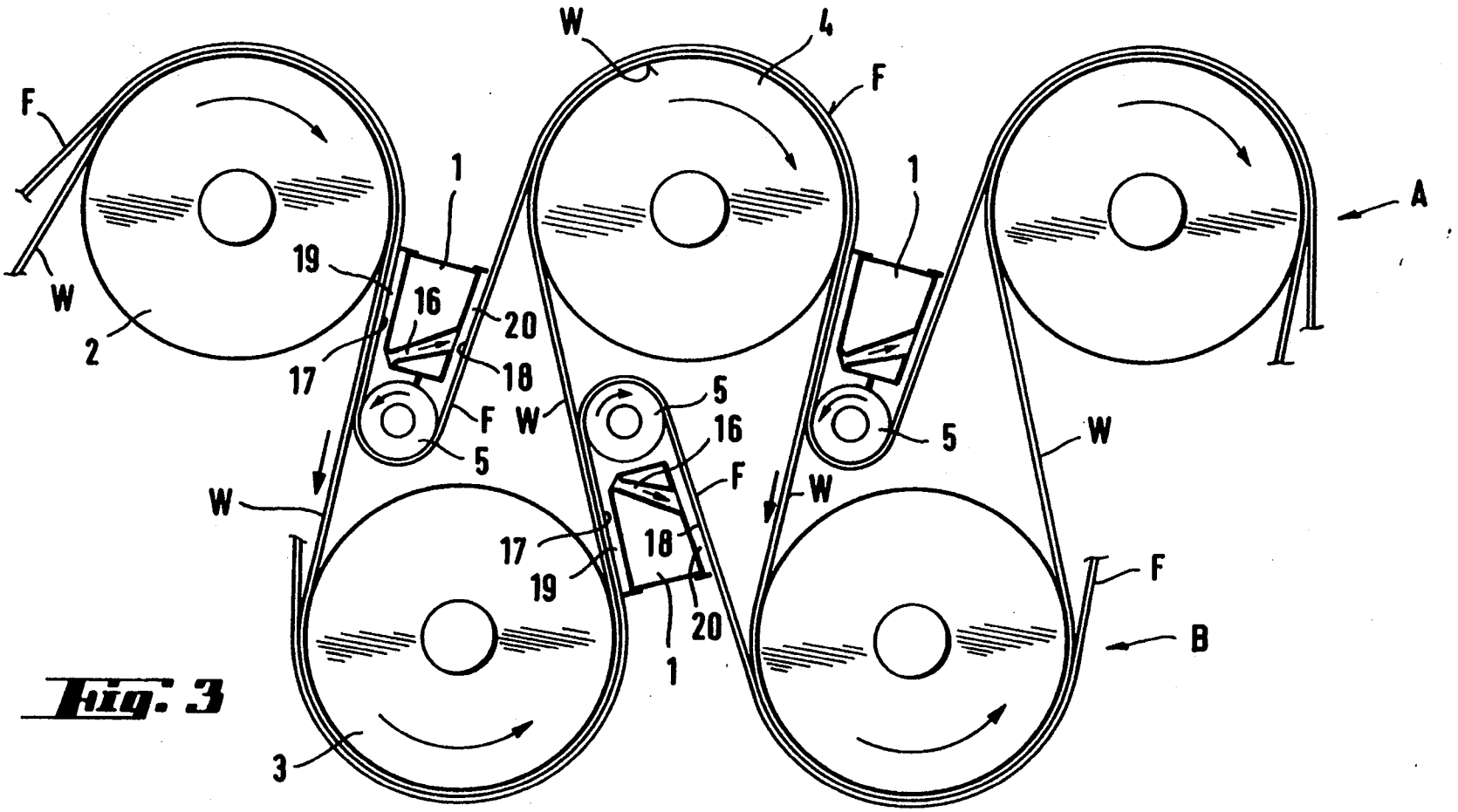
FIG. 3 is a side view of a double fabric configuration, employing an apparatus of the invention.

FIG. 3 illustrates part of a dryer section of the invention, including boxes 1 according to the novel solution mounted at the same locations as in the dryer section of FIG. 1, the design and disposition of these boxes relative to sections 17 and 18 of fabric F being described hereinafter.

Figure 4A:
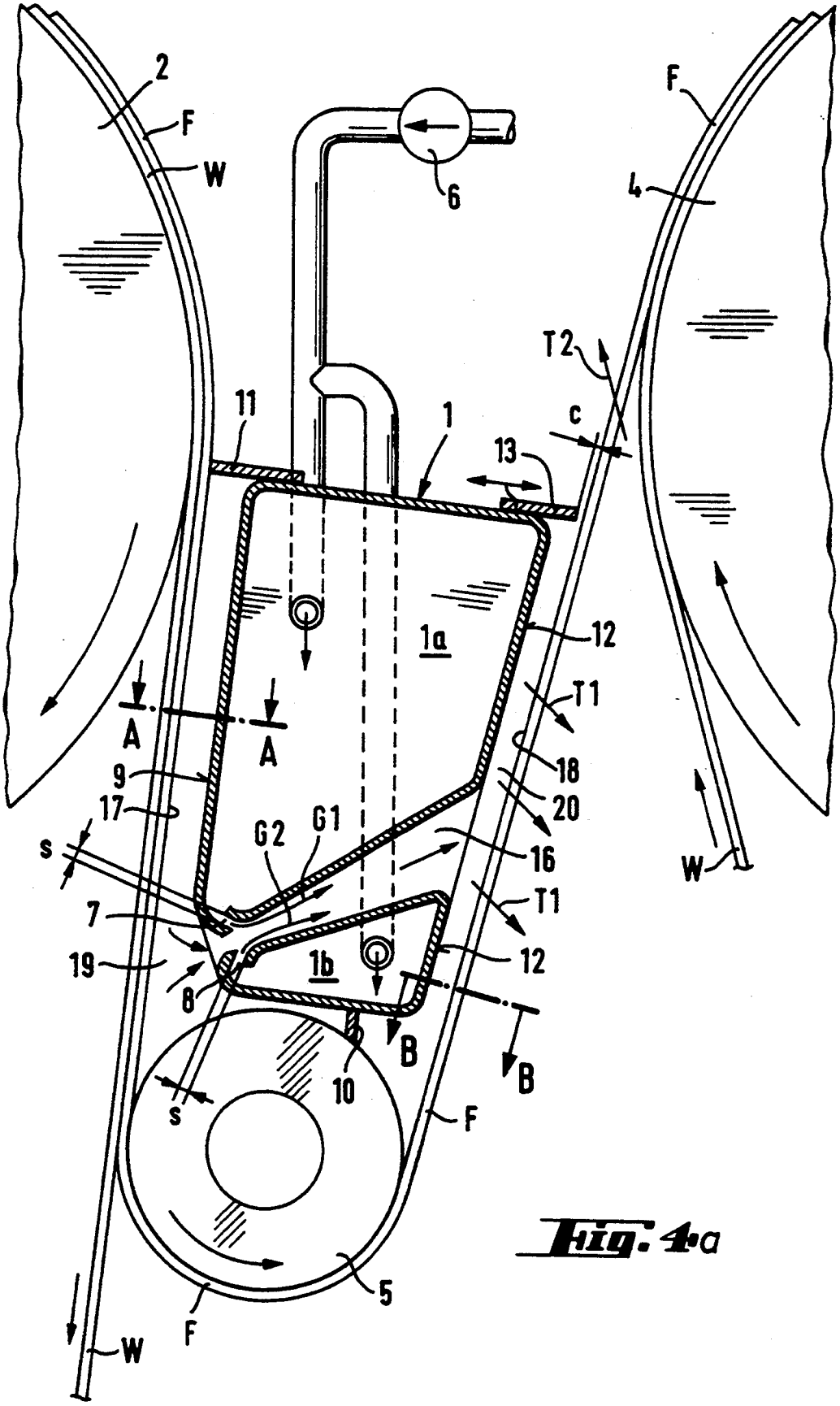
FIG. 4*a* is a larger-scale view of the apparatus of FIG. 3 as a cross-section in the machine direction.

FIG. 4*a* shows the realization of a blow box 1 according to the present invention. Compensation air is blown into both chambers 1*a* and 1*b* of a blow box by means of a fan 6. The walls of chambers 1*a* and 1*b* are each provided with a slit orifice 7 and 8, generally having widths of 1–6 mm, preferably about 1–5 mm. Slit orifices 7 and 8 open into the walls of chambers opposite to each other. The configuration of each slit orifice is such that it is formed between the overlapping ends of wall sections upstream of the nozzle and downstream of the nozzle. The chamber walls downstream of the nozzles are at first nearing towards each other slightly and then provide therebetween an expanding flow path 16 directed towards the open section of dryer fabric F. At the narrowest point, the relative distance between the walls is approximately 15–50 mm, preferably about 30 mm. The slit orifices discharge air jets G1 and G2 which aspirate air from a zone 19 defined by a carrier surface 9 created by the outer wall of one chamber 1*a*, a web W supporting section 17 of fabric F opposite to the carrier surface, and the jacket of fabric guide roll 5 uncovered by the fabric for creating a vacuum within this zone. Since fabric F is previous to air, web W is pulled into the contact with fabric F and thus runs in a stable fashion. A sealing 11 is used for preventing the air pumped by the fabric from passing in between blow box 1 and fabric F. The sealing is attached to chamber 1*a* and seals the space between surface 9 and fabric F in the fabric traveling direction definitely not later than the point at which the fabric and the web disengage from cylinder 2. A sealing 10 is fitted between the uncovered jacket of fabric guide roll 5 and the wall of second chamber 1*b* opposite thereto and used for preventing the air pumped by roll 5 from passing into the vacuumed zone 19 defined by fabric F.

The air jets discharging from the nozzles travel along flow path 16 and find their way into a space 20 defined by a free or uncovered fabric section 18 and the opposite outer surfaces 12 of chambers 1*a* and 1*b* opposite thereto, the flow path opening into the space. This flow or current produces an overpressure or plenum in this space or zone. The overpressurized air discharges (T1) into a pocket located on the other side of this section through the air permeable fabric for thus preventing the generation of a vacuum in the pocket. From the pocket, the air discharges out (T2) between box 1 and cylinder 4 through that part of uncovered section 18 of fabric F which extends between box 1 and cylinder 4. The flow stabilizes on this cylinder 4 the run of web W approaching from the direction of the cylinder 3 of second tier B prior to laying fabric F on top of it.

A sealing 13, whose position is adjustable in the direction perpendicular to the fabric and which is attached to chamber 1*a* for partially sealing a gap between surface 12 and uncovered fabric section 18, is used for preventing the discharge of air from between surface 12 and fabric F towards the fabric traveling direction. The distance of this adjustable sealing from the fabric (distance c) is generally 2–20 mm, preferably 3–10 mm.

According to section A—A in FIG. 4*b*, the box is provided with edge nozzles 14, opening from chamber 1*b* and mounted on the edges of the common fabric and web section 17 on the drive side and maintenance side. When blowing sideways from the nozzles, the air jets serve to eject air from a space between fabric F and the blow box for an increased vacuum at the edges.

According to section B—B in FIG. 4*c*, the box is provided with sealings 15 fastened to chamber 1*a* at the edges of uncovered section 18 of fabric F on the drive side and maintenance side. Sealings 15 are used for preventing the lateral discharge of air and, thus, air currents T1 are directed into the pocket. The position of these sealings located in the fabric traveling direction may also be adjustable in the direction perpendicular to the plane of the fabric.

The employed sealings are flexible, causing no damage to the fabrics.

The amount of air required by the apparatus is approximately 800–1000 $m^3h$/meter in lateral direction, which is substantially less than what is required by the prior known equipment.

The ejector assembly can also be designed by using just a single slit orifice and a wall on the other side deflecting the air discharging therefrom, the wall creating, together with a wall following the slit orifice, a flow path directed towards the uncovered fabric section. However, the slit orifices included in both walls are capable of intensifying the ejector effect and, thus, the flow rate of air blowing from the individual nozzles will be lower.

In addition, it is possible to apply the effect of air currents on a certain section of the fabric and web edge area, for example, on the width of approximately 500–800 mm at the edge of the maintenance side, in order to secure the run of a tail (threading strip) located within this lateral zone during the course of threading. In practice, box 1 can be divided for example, in the cross-machine direction into two chambers, one being a primary chamber and the other a secondary chamber, the latter being located within the above lateral zone. Regulating dampers are provided between the chambers. The blowing air is delivered into the secondary chamber and, with the dampers in a closed position, the blowing affects only within the lateral zone the threading strip and, with the dampers in an open position, the blowing affects across the entire width of the box the full-width web.

I claim:

1. An apparatus in the dryer section of a papermaking machine in a double fabric configuration, including cylinders positioned in two tiers between which a web to be dried is adapted to travel in a tortuous path such that it is supported against the cylinders of one and the same tier by means of one and the same support element, said web having a free run between cylinders of different tiers and said support element being run between the adjacent cylinders positioned such that said support element supports web over a section between a cylinder and the guide roll, said apparatus comprising an air blow box located within a loop of the support element formed around said guide roll between said adjacent cylinder, said box being adapted to blow air for producing a vacuum within said loop in a space defined by said section of the support element carrying said web and for delivering air to the opposite side of the loop through a section of the support element uncovered by the web, said blow box including a blow chamber, into whose wall opens a nozzle which, together with an opposite wall included in the box, forms an ejector assembly and the walls form therebetween a flow math directed towards said uncovered section of the support element, said nozzle being directed towards the flow path for delivering an air current discharging therefrom through the flow path and into a space defined by said uncovered section of the support element and also for creating said vacuum by virtue of the same air current in said space defined downstream the ejector assembly by said section of the support element carrying the web.

2. An apparatus as set forth in claim 1, wherein the wall opposite the nozzle is provided with a second nozzle, which is in communication with a second blow chamber and directed towards the flow path in the same way as the first nozzle.

3. An apparatus as set forth in claim 1, wherein said space confined by the uncovered section of the support element is sealed by means of a sealing fitted between the air blow box and the support element.

4. An apparatus as set forth in claim 3, wherein the position of the sealing is adjustable in the direction perpendicular to the plane of the support element.

5. An apparatus as set forth in claim 2, wherein said space confined by the uncovered section of the support element is sealed by means of a sealing fitted between the air blow box and the support element.

6. An apparatus for use in the dry section of a papermaking machine with a double fabric configuration including plurality of cylinders positioned in two tiers and a guide roll between adjacent cylinders, wherein a web to be dried travels between said cylinders of said two tiers such that it is supported against cylinders of one and the same tier by a continuous support element running between two adjacent cylinders around said guide roll, said apparatus comprising:

an air blow box located within a space defined between a) a surface of said guide roll which is not covered by said supporting member, b) a first section of said supporting element extending between one cylinder in each tier and said guide roll, said first section supporting and being covered by said web, and c) a second section of said supporting element extending between the same guide roll and said adjacent cylinder which does not support and is not covered by said web;

said air blow box including a blow chamber having at least one wall provided with a nozzle and an opposite wall, said nozzle and said opposite wall forming an ejector means, and said walls forming therebetween a flow path leading from said nozzle towards said second, uncovered section of said supporting element, said nozzle delivering an air current discharging therefrom through said flow path towards and through said second uncovered section and simultaneously by the same air current creating vacuum in a potion of said space defined downstream said nozzle, between said uncovered surface of said guide roll and said first section of said supporting element covered by said web.

* * * * *